US006427365B2

(12) United States Patent
MacGregor et al.

(10) Patent No.: US 6,427,365 B2
(45) Date of Patent: Aug. 6, 2002

(54) FLUID SUPPLY AND RESERVOIR FOR A CLOTHES REFRESHING APPLIANCE

(75) Inventors: Bruce Grant MacGregor, Palo Alto; Alex Kazaks, Mountain View, both of CA (US); Bradford W. Flora, St. Joseph, MI (US); Henry F. Doersam, Evansville, IN (US); George Crothall, San Jose; Ana Taiyuan Chang, Sunnyvale, both of CA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/824,288

(22) Filed: Apr. 2, 2001

Related U.S. Application Data

(60) Provisional application No. 60/205,629, filed on May 18, 2000.

(51) Int. Cl.[7] ..... D06F 59/02
(52) U.S. Cl. ..... 38/1 A
(58) Field of Search ..... 38/1 A, 77.1; 223/51; 34/77

(56) References Cited

U.S. PATENT DOCUMENTS 3,475,828 A * 11/1969 Feldman et al.
3,670,425 A * 6/1972 Benjamin et al.
3,805,561 A * 4/1974 Bullock
4,096,714 A 6/1978 Nirenberg ..... 68/5 C
5,305,484 A * 4/1994 Fitzpatrick et al.
5,361,516 A * 11/1994 Dahman
5,381,574 A 1/1995 VonPless ..... 8/149.2
5,815,961 A 10/1998 Estes et al. ..... 38/14

* cited by examiner

*Primary Examiner*—Ismael Izaguirre
(74) *Attorney, Agent, or Firm*—Thomas J. Roth; Robert O. Rice; Stephen Krefman

(57) ABSTRACT

A fluid supply and reservoir is proved which may be used in conjunction with a clothes refreshing appliance. A fluid cartridge has a top wall to which the nozzle assembly may be secured, and a supply of pressurized air is connected to the nozzle assembly to draw fluid from the reservoir into the nozzle assembly through a siphon tube by a venturi action. The air supply may be provided through an air supply arrangement which includes guide walls for positioning the nozzle assembly relative to the air supply, and a resiliently mounted air supply tube for mating with an air supply opening in the nozzle assembly. An arrangement may also be provided in the reservoir to assure a constant fluid pressure therein to provide a constant flow of fluid through the nozzle assembly.

30 Claims, 5 Drawing Sheets

FIG. 12
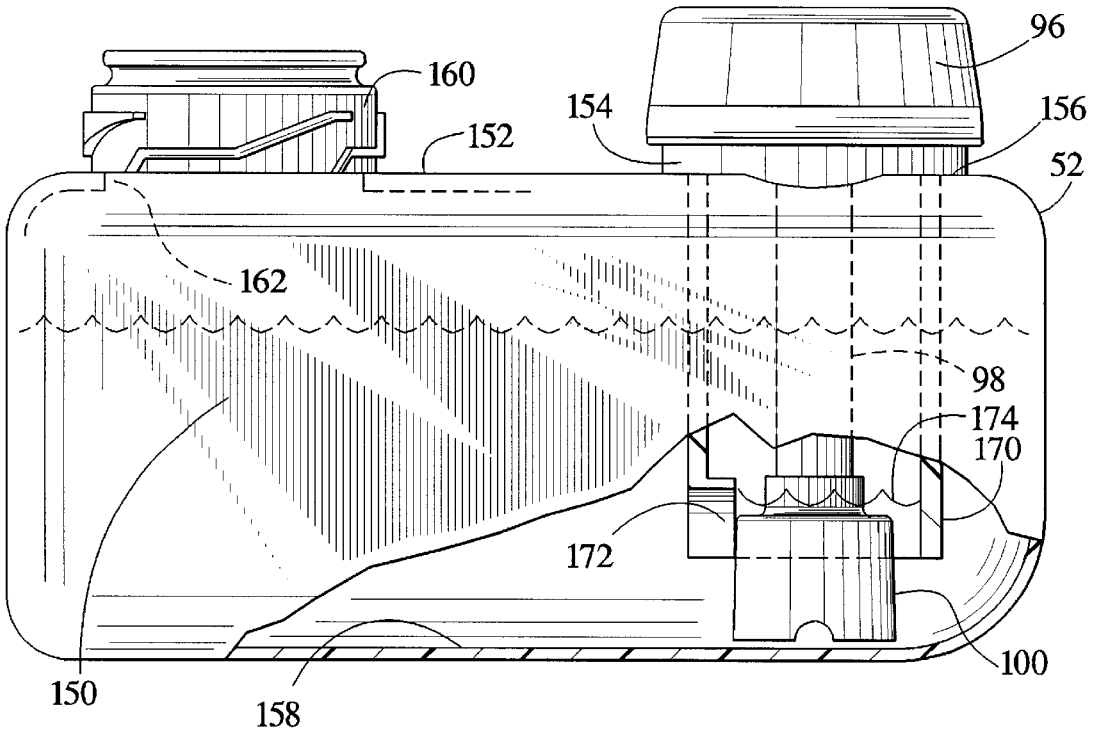
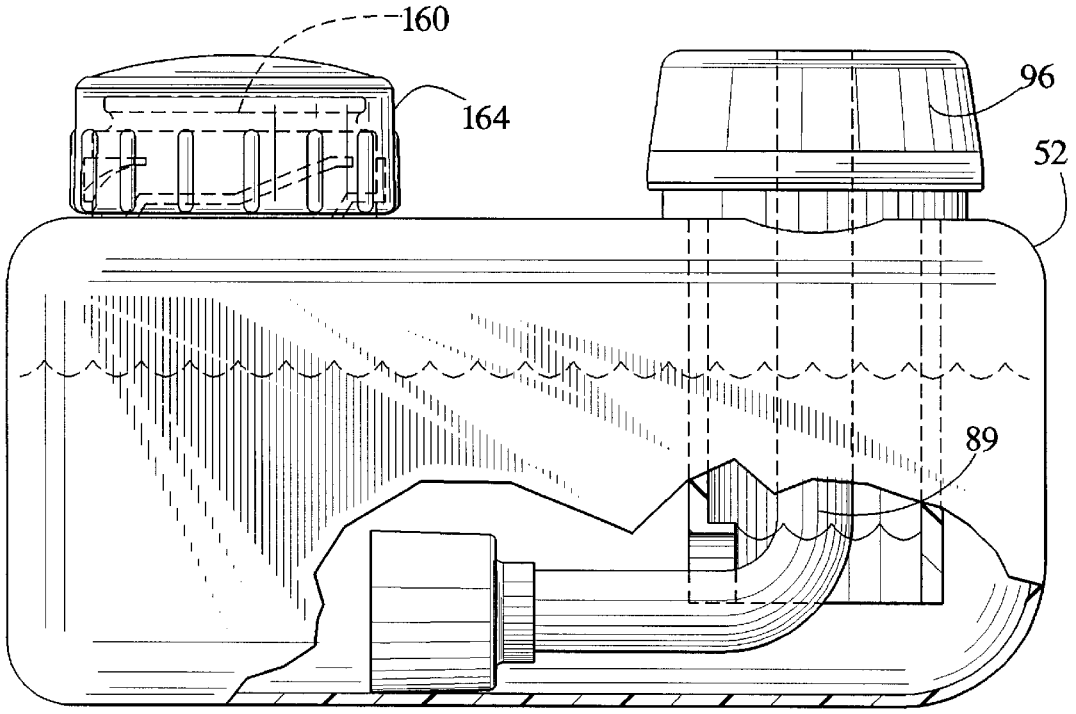
FIG. 13

FLUID SUPPLY AND RESERVOIR FOR A CLOTHES REFRESHING APPLIANCE

This application claims benefit of provisional application No. 60/205,629, filed May 18, 2000.

BACKGROUND OF THE INVENTION

The present invention relates to a fluid supply and reservoir useful in a clothes refreshing appliance, and more particularly, to a removable and serviceable combination nozzle and cartridge or a cartridge useable in such an appliance.

A clothes refreshing appliance is disclosed in U.S. Pat. No. 5,815,961. In such an appliance, provision is made for the introduction of moisture in the form of steam or mist.

While the provision of heat and moisture is beneficial as disclosed, it would be an improvement in the art if there were provided an apparatus for introducing other materials, such as liquids or fluids into the interior of the clothes refreshing appliance and into an air stream flowing therethrough for application onto the clothes in the appliance.

Also, it would be an improvement in the art if a fluid supply and reservoir were provided which permitted easy serviceability of the nozzle, refill capabilities of the cartridge, replacement with a new, filled cartridge, and ease of use and assembly of the fluid supply and reservoir.

SUMMARY OF THE INVENTION

The present invention provides an apparatus for dispensing fluids into the interior of a clothes refreshing appliance such that the dispensed fluids are entrained into the air flow within the appliance to be deposited onto the clothes within the appliance.

In a preferred arrangement, the apparatus comprises a reservoir for containing fluid formulated to be sprayed onto clothing articles carried in the clothes refreshing appliance and a nozzle through which the fluid is to be dispersed. The nozzle may be separable from the reservoir for ease of replacement and serviceability. Also, the entire reservoir may be formed as a cartridge which can be removable from the interior of the cabinet for replenishment of the fluid by refilling of the existing cartridge or replacement with a new prefilled cartridge.

Preferably a source of compressed or pressurized air is provided which is used to dispense the fluid through the nozzle by means of a venturi arrangement. Where the fluid cartridge is removable, guide arrangements are provided to align the cartridge and nozzle assembly with the source of compressed air in order to assuredly align the cartridge in an automatic manner without requiring extensive operation by the user.

In a particular embodiment, the fluid cartridge can be arranged to maintain a constant siphon height for fluid contained within the cartridge in order to provide for consistent dispensing of the fluid.

Thus, the present invention provides several advantages in a dispensing of fluid through the use of a separable and replaceable nozzle and fluid cartridge assembly including: providing a readily serviceable nozzle in that the nozzle can be replaced separate and apart from the fluid cartridge, the fluid cartridge itself is changeable so a number of different chemistries can be used as fluids in different prefilled cartridges, the cartridge is easily fillable and refillable so the various chemistries can be sold in bulk for economy to the user or the cartridge, which is easily replaceable can be provided separately and prefilled, and the cartridges can be arranged to provide consistent dispensing through the use of an automatic siphon height adjustment arrangement.

BRIEF DESCRIPTION OF THE DRAWINGS

FIG. 12 is a rear elevational view of an embodiment of a fluid cartridge portion of the fluid supply and reservoir illustrated in FIG. 5.

FIG. 13 is a rear elevational view of an embodiment of a fluid cartridge portion of the fluid supply and reservoir illustrated in FIG. 5 having a longer siphon tube.

DETAILED DESCRIPTION OF THE PREFERRED EMBODIMENTS

The present invention relates to a fluid supply and reservoir in which fluid can be dispersed from the reservoir through a nozzle. The invention finds particular utility in a clothes treating apparatus such as a clothes refreshing appliance of the type disclosed in U.S. Pat. No. 5,815,961, the disclosure of which is incorporated herein by reference. However, the present invention is not limited to use in such an apparatus and can be used in a variety of apparatus and applications where a fluid is to be dispensed through a nozzle.

For purposes of providing an explanation of the present invention in a useful environment, this disclosure will describe a fluid supply and reservoir incorporating the principles of the present invention in the environment of a clothes refreshing appliance.

Figure 1:
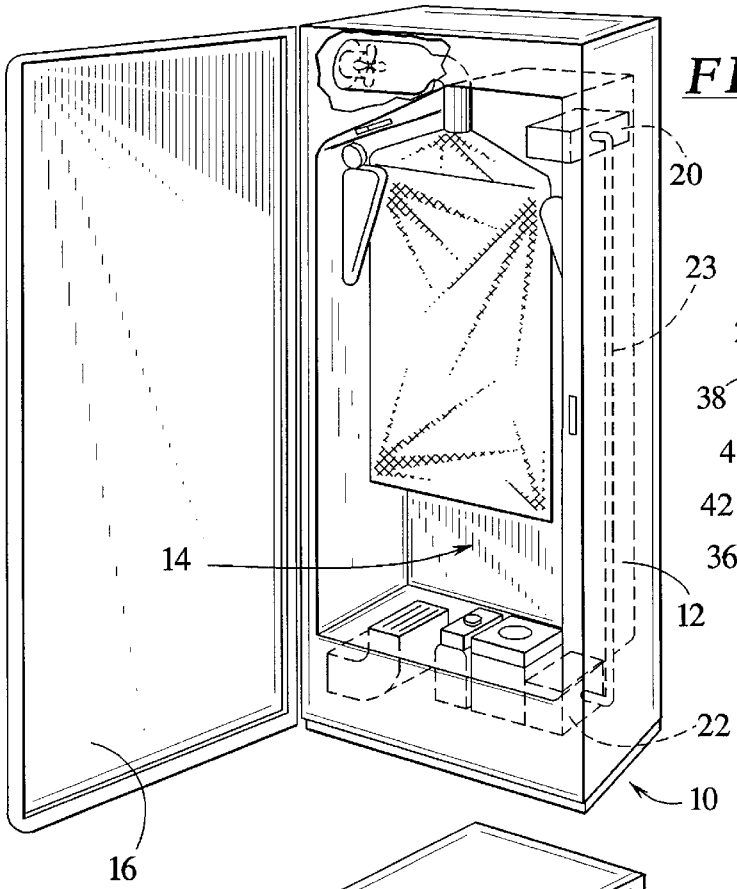
FIG. 1 is a top, front perspective view of the clothes treating cabinet apparatus in which the present invention can be utilized.

Referring to FIG. 1, there is illustrated a clothes treating apparatus generally at 10 which can be used for steaming, de-wrinkling, deodorizing and otherwise treating clothing. The apparatus 10 includes a main housing or cabinet 12. The cabinet 12 forms an interior region 14 which comprises a space for receiving clothing articles. One or more doors 16 are hingedly connected to the cabinet 12 for closing the interior region 14 formed by the cabinet 12. As disclosed in U.S. Pat. No. 5,815,961, various inlets and outlets (not all specifically shown here) are to be provided in the apparatus for conducting treated and untreated air into the interior region 14 and for exhausting air from the interior region.

The present invention comprises a fluid supply and reservoir 20 which can be positioned within the interior region 14 of the cabinet to dispense fluid into the interior in atomized or vaporized form.

In a preferred arrangement a source of compressed or pressurized air 22 communicates with the fluid supply and reservoir 20 through a supply line 23 to assist in dispensing the fluid to the interior 14 of the clothes refreshing appliance 10. Although the fluid supply and reservoir 20 is shown as being located near an upper end of the interior region 14 of the cabinet 12, it could also be located at an intermediate position or even in a lower position beneath the clothing articles.

Figure 4:
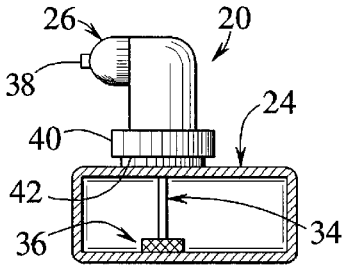
FIG. 4 is a side view, partly in section, of the fluid supply and reservoir of FIG. 2.
Figure 2:
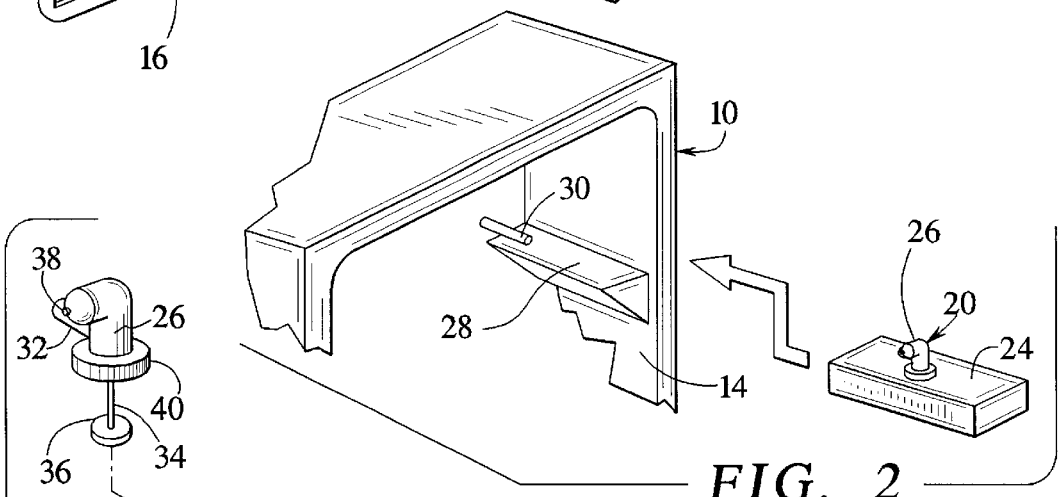
FIG. 2 is a perspective view of a fluid supply and reservoir embodying the principles of the present invention and illustrating its placement relative to a clothes treating cabinet apparatus.
Figure 3:
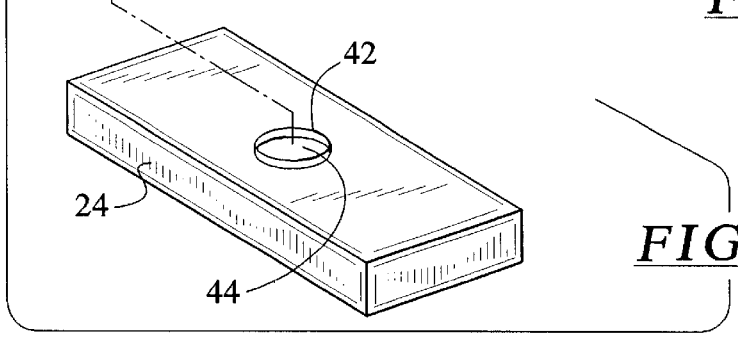
FIG. 3 is an exploded view of the fluid supply and reservoir of FIG. 2.

FIGS. 2–4 illustrate a first embodiment of the fluid supply and reservoir 20 where it is seen that there is an assembly of a fluid reservoir cartridge 24 and a dispensing nozzle assembly 26. The complete assembly is received on a shelf 28 which extends into the interior 14 of the clothes refreshing appliance 10 and an air supply tube 30 leading from the supply line 23 mates with a complementarily shaped tube 32 on the nozzle assembly 26 to supply the compressed or pressurized air to the nozzle assembly. The nozzle assembly 26 includes a siphon tube 34 having an open lower end surrounded by a filter element 36 which is received in the fluid cartridge 24 so that fluid in the cartridge is drawn through the filter element 36 and up the siphon tube 34 into the nozzle assembly 26. A standard venturi arrangement is provided within the nozzle assembly 26 such that the compressed or pressurized air received through tube 32 of the nozzle assembly will cause fluid to be drawn up through the siphon tube 34 from the fluid cartridge 24 and to be dispensed out through a nozzle opening 38 in the nozzle assembly 26. The nozzle assembly 26 can also include a cap portion 40 which is received on an upstanding wall 42 of the fluid cartridge 24 either by a snap on, friction fit or screw-on arrangement to hold the nozzle assembly 26 on the fluid cartridge 24 as a single assembly. With the nozzle assembly 26 removed, the resulting opening 44 within the upstanding wall 42 of the fluid cartridge 24 can act as an opening for filling or refilling the fluid cartridge 24.

Thus, in operation, the embodiment shown in FIGS. 2–4 operates by first disassembling the nozzle assembly 26 from the fluid cartridge 24 as shown in FIG. 3, in order to supply an appropriate fluid to the interior of the fluid cartridge 24. The nozzle assembly 26 is then reunited with the fluid cartridge 24 so that the filter element 36 will be positioned closely adjacent to a bottom of the fluid cartridge as shown in FIG. 4. This assembly is then placed onto the shelf 28 and moved rearwardly so that the air supply tube 30 will mate with the tube 32 of the nozzle assembly 26. Preferably these two tubes 30, 32 can be conically shaped to provide a tight seal between the two tubes. Then, when compressed or pressurized air is supplied through the tubes 30 and 32 to the nozzle assembly 26, fluid is drawn up into the nozzle assembly 26 and the combined fluid and air is dispensed through the nozzle opening 38.

Figure 5:
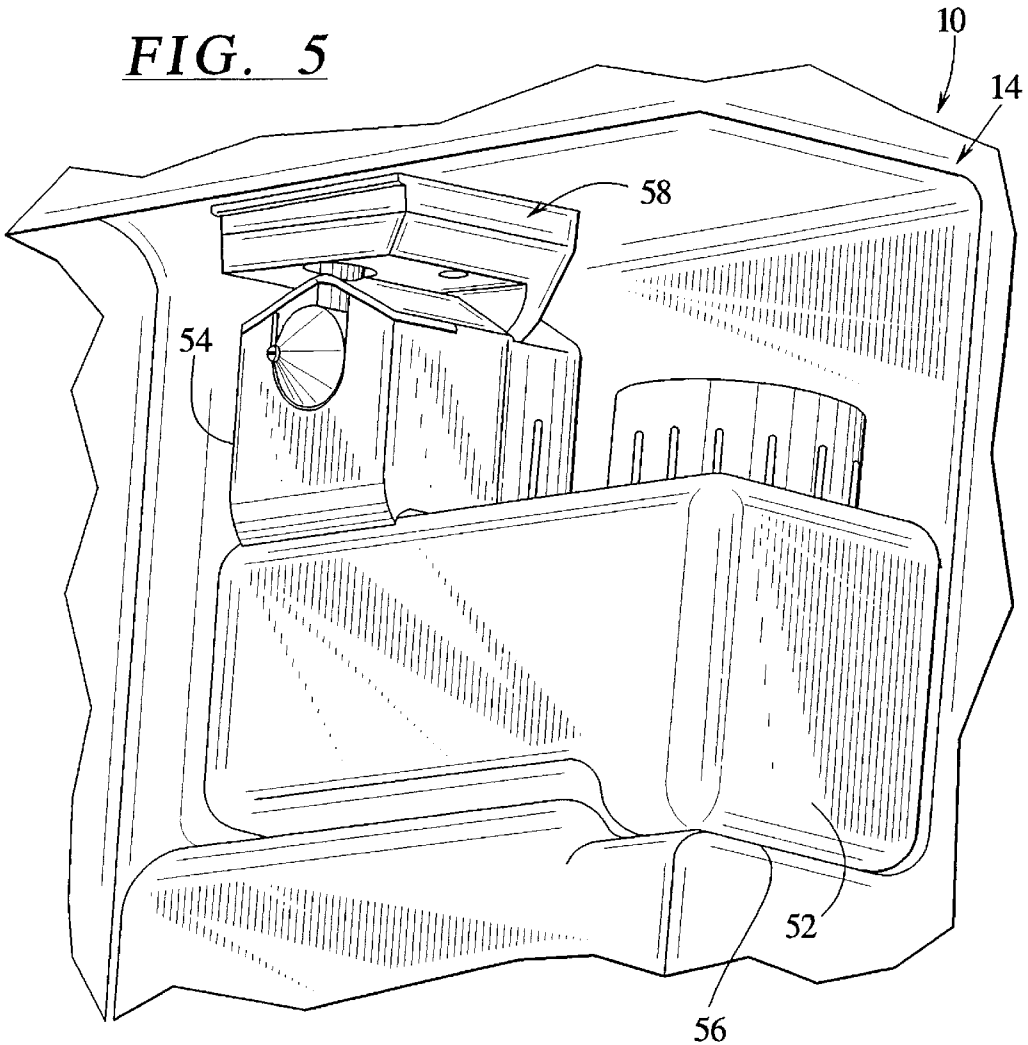
FIG. 5 is a perspective view of an alternate embodiment of a fluid supply and reservoir embodying the principles of the present invention.
Figure 6:
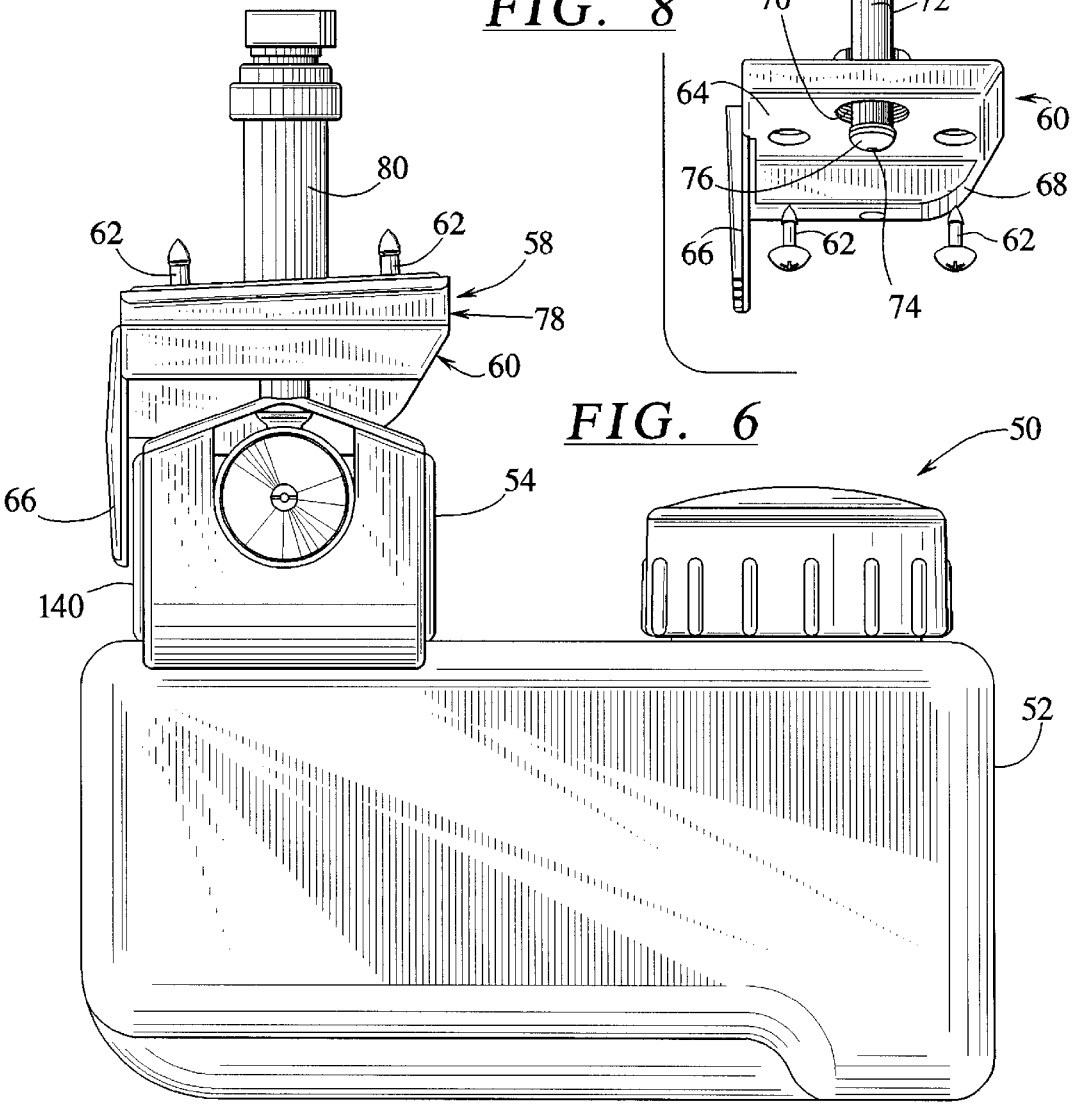
FIG. 6 is a front elevational view of the fluid supply and reservoir of FIG. 5.

Another embodiment of a fluid supply and reservoir is shown at 50 in FIGS. 5 and 6.

Again the fluid supply and reservoir 50 includes an assembly of a fluid reservoir cartridge 52 and a dispensing nozzle assembly 54. The complete assembly is received on a shelf 56 having a surface area which is substantially planar and which extends into the interior 14 of the clothes refreshing appliance 10 similar to the manner described above. In this embodiment, an air supply assembly or dock 58 is provided above the nozzle assembly 54. The air supply assembly 58 is retained within the interior of the clothes refreshing appliance 10 while the nozzle assembly 54 and fluid cartridge 52 are removable and replaceable relative to the clothes refreshing appliance 10.

Figure 7:
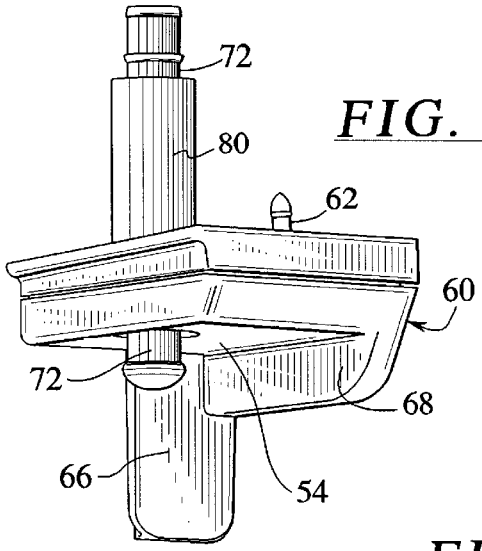
FIG. 7 is a perspective view of a pressurized air supply portion of the fluid supply and reservoir of FIG. 5.
Figure 8:
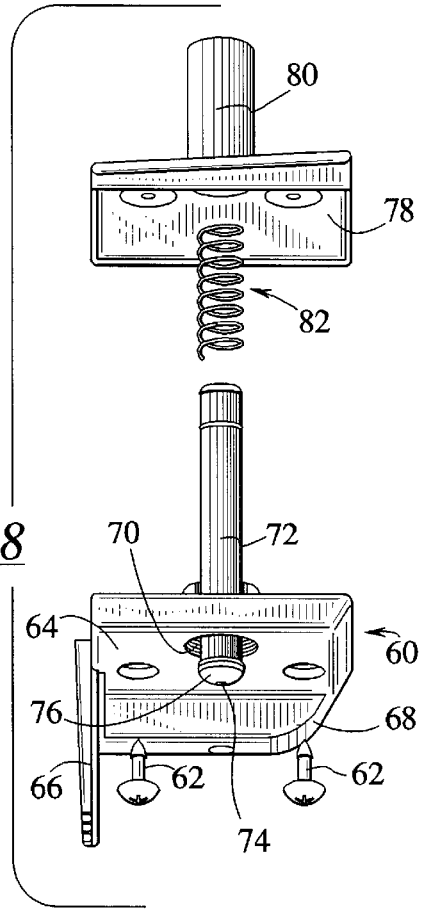
FIG. 8 is an exploded view of the air supply portion of FIG. 7.

The air supply assembly 58 is shown in greater detail in FIGS. 7 and 8 where it is seen that there is a guide member 60 which can be secured to a relatively horizontal top wall of the interior region 14 of the clothes refreshing appliance 10 by appropriate fasteners 62. The guide member 60 includes a horizontal plate 64 that has a first downwardly extending wall 66 formed at one edge which acts as a stop member for the nozzle assembly 54 as shown in FIG. 6.

A second downwardly extending wall 68 is provided at right angles to the stop wall 66 and acts as a guide for the nozzle assembly 54 as is described below.

Centrally in the plate member 64 is an opening 70 through which extends an air supply tube 72 having an opening 74 in a lower end thereof. The lower end has a partially spherical shaped surface 76 to mate with a shaped surface in the nozzle assembly 54 as described below. The air tube 72 extends upwardly through an upper horizontal plate member 78 and a vertical tube 80 to where it is connected to a flexible tube comprising the compressed or pressurized air supply line 23.

The air tube 72 engages a spring 82 such that the air tube 72 can move vertically within the tube 80, but is spring biases the air tube 72 downwardly so that it will press into tight engagement with the nozzle assembly 54 as described below.

Figure 11:
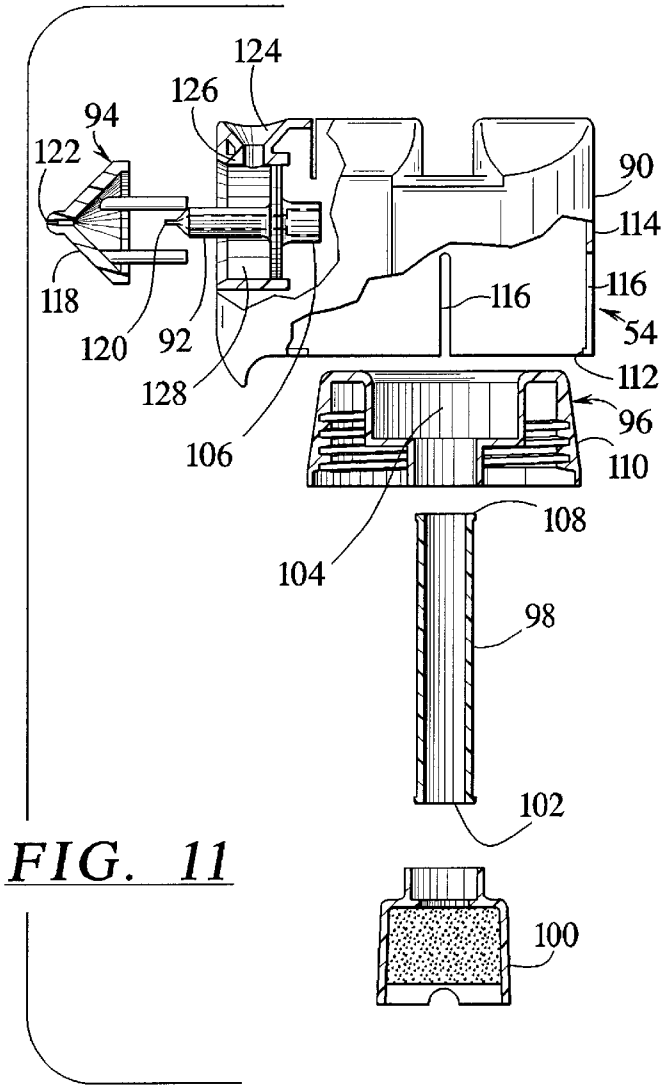
FIG. 11 is a side sectional exploded view of the nozzle assembly of FIG. 9.
Figure 10:
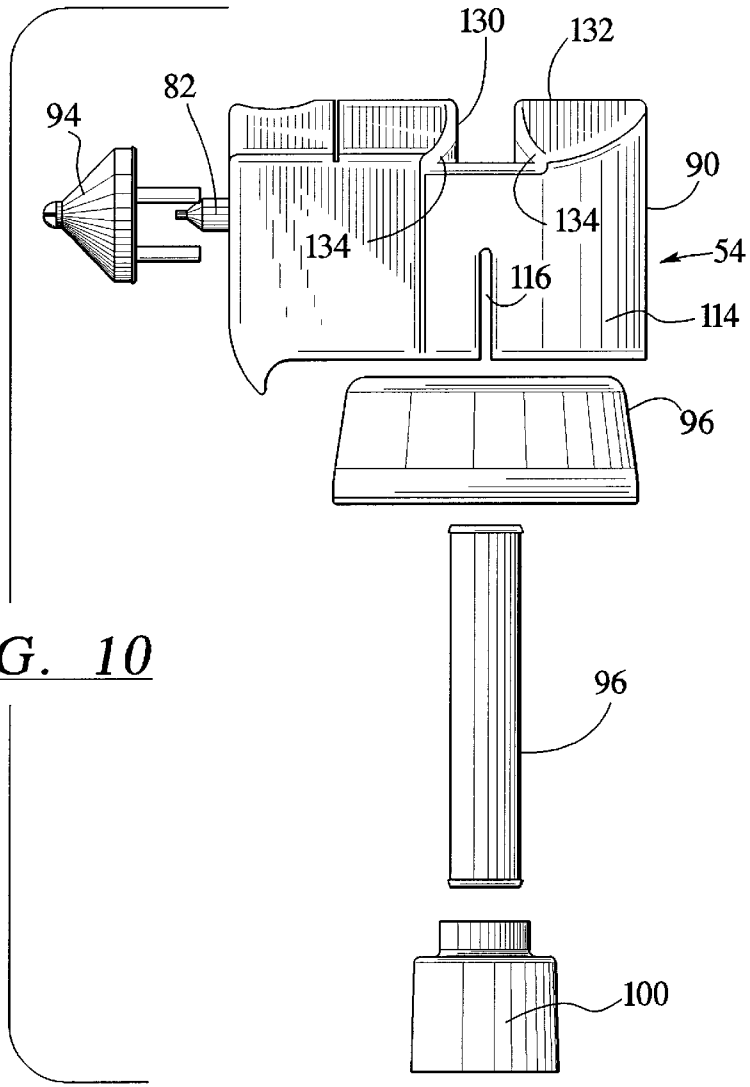
FIG. 10 is a side elevation exploded view of the nozzle assembly of FIG. 9.
Figure 9:
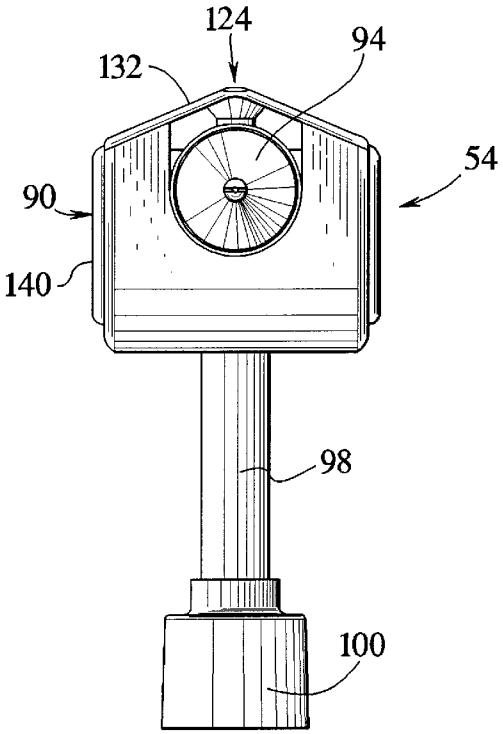
FIG. 9 is a front elevational view of a nozzle assembly of the fluid supply and reservoir of FIG. 5.

The nozzle assembly 54 is shown in FIGS. 9–11 and is comprised of several parts. The various parts include a housing 90, a fluid nozzle 92, an outlet nozzle 94, a cap 96, a flexible siphon tube 98 and a filter element 100. The siphon tube 98 has an open bottom end 102 which is inserted and captured in the filter element 100. The cap 96 has a central opening 104 which allows the siphon tube 98 to loosely pass through the cap and up into the interior of the housing 90. The fluid nozzle 92 is horizontally arranged and has a rearward facing nipple 106 into which a second open end 108 of the siphon tube 98 attaches by a friction fit. Thus, a fluid communication path is provided from the filter element 100 through the siphon tube 98 to the fluid nozzle 92.

The cap 96 has an outwardly and downwardly flared outer circumference 110 which is received in an opening 112 formed in the bottom of the housing 90. Walls 114 of the housing are provided with a series of vertical slits 116 which permit the walls 114 to spread slightly as the cap 96 is inserted into the opening 112. The walls 114 are preferably formed of a resilient plastic material so that the cap 96 will be resiliently and frictionally held in the housing 90 as it is pressed upwardly into the opening 112. The outer nozzle 94 has a conically shaped wall 118 which is placed in a surrounding relationship with an open end 120 of the fluid nozzle 92 and then the outer nozzle 94 is secured to the housing 90, such as by heat staking or other appropriate means.

A forward end of the outer nozzle 94 includes an opening 122 through which a mixture of fluid entrained by venturi action and air can be dispensed. The housing includes a depression 124 at a top wall thereof which includes a passage 126 communicating with a chamber 128 that, in turn, communicates with the conical chamber surrounding the open end 120 of the fluid nozzle 92. The surface 124 is shaped, such as in the form of a conic, so as to mate in a sealing fashion with the partially spherical surface 76 of the air tube 72 described above with respect to FIGS. 7 and 8. Thus, there is a flow path for the pressurized air leading from the air tube 72 through passage 126 and into chamber 128 and out through outer nozzle opening 122. Through the known venturi effect, the flow of air passing from chamber 128 through nozzle opening 122 will draw fluid through opening 120 in fluid nozzle 92, which fluid is drawn up through the siphon tube 98 and filter element 100.

The housing 90 also has a slot 130 formed in a top wall 132 for receiving the second downwardly depending wall 68 of the air supply member 60. The slot 130 includes outwardly flared sidewalls 134. Thus, as the nozzle assembly 54 is inserted in relationship to the air supply device 58, the user can readily aligned the slot 130 with the second wall 68 so that the nozzle assembly 54 will be arranged in proper alignment with the air supply device 58 such that the air supply tube 72 will properly seat in the depression 124 of the housing 90. The insertion motion of the nozzle assembly 54 relative to the air supply device 58 will be stopped by the first downwardly depending wall 66 which will be engaged by a sidewall 140 of the housing 90 as best seen in FIG. 6. In this manner the depression 124 in the housing 90 will be properly aligned with the air supply tube 72 in both a front-to-rear and side-to-side direction. The spring loaded yet vertically movable air supply tube 72 will be permitted to first ride upwardly on the sloped top wall 132 of the housing (as seen in FIG. 9) and then to be captured in the depression 124 as described.

The fluid cartridge 52 is shown in greater detail in FIGS. 12 and 13 where it is seen that the cartridge 52 is essentially a relatively large hollow reservoir or container body for receiving a fluid 150 formulated to be sprayed onto the clothing articles carried in the clothes refreshing appliance. The cartridge includes a top wall 152 which has a first upstanding wall 154 formed thereon which receives the cap 96 of the nozzle assembly 54. The upper portion of the nozzle assembly 54 is not illustrated in FIG. 12 for purposes of clarity. The cap 96 can be retained on the wall 154 by means of a snap fit connection, a friction fit or a screw thread connection. That is, generally, the wall 154 has a surface configuration arranged to securely connect with the cap 96 which forms a connection element for the nozzle. The wall 154 surrounds an opening 156 in the top wall through which the siphon tube 98 can extend. The filter element 100 can extend down to essentially rest on or be positioned just above a horizontal bottom wall 158 of the cartridge 52.

The top wall 152 has a second upstanding wall 160 which leads to a second opening 162 which can be used for filling or re-filling the cartridge with appropriate fluids. A second cap 164 may be provided to sealingly close, by means of a seal member such as an O-ring 163, the opening 162 and can be retained on the wall 160 by appropriate means including screw threads, friction fit, snap fit or other known removable fastening arrangements.

In a preferred arrangement, a mechanism may be provided for assuring a consistent dispensing of fluid from the cartridge. If no special arrangement were provided, the dispensing of fluid from the cartridge would vary as the depth of fluid in the cartridge varies. In order to provide a more consistent flow at all depths of fluid within the cartridge, a cylindrical wall 170 may be provided which can be secured to the nozzle assembly cap 96 and which extends downwardly into the cartridge, but terminates above the floor 158 of the cartridge.

A slot or other opening 172 is provided near a bottom end of the cylindrical wall 170. The interior of the cylindrical wall 170, above the fluid level is open to atmosphere through the opening 104 in the cap and the slot 130 in the housing 90, however, the interior of the cartridge 52 above the fluid level is not open to atmosphere, but rather is sealed off from atmosphere by the cap 164. Thus, as fluid is withdrawn from the cartridge 52, a vacuum develops above the fluid level in the cartridge, thus preventing the fluid level in the cartridge from lowering. However, fluid within the cylindrical wall 170 is exposed to atmospheric pressure and thus the level does drop within the cylindrical wall 170 until the fluid level reaches the top of the opening 172, as shown at 174 in FIG. 12. As the fluid level drops below the top of the opening 172, air will be drawn from within the cylindrical wall 170 into the main portion of the cartridge 52 thus reducing the vacuum and permitting some fluid from the cartridge to flow up into the interior of the cylindrical wall until the fluid level is again restored at the top of the opening 172. Hence, the fluid pressure within the cartridge 52 will stabilize at that pressure corresponding to the column of fluid with a height from the floor 158 of the cartridge up to the top of the opening 172, and the pressure will remain relatively constant until the overall fluid level drops below the top of the opening.

It will be appreciated that the cartridge 24, 52 can be configured differently than shown in the illustration of the preferred embodiment and still incorporate the principles of the present invention. For example, even though the preferred embodiments illustrate a top wall having one or two openings therein surrounded by walls, the cartridge could be formed with a removable upper section which is replaced by a nozzle assembly, such that the entire top surface of the cartridge is removed when in use. Also, the opening for filling or refilling of the cartridge could be located at a location other than a top surface, as could the connection for the nozzle. The preferred embodiments illustrate a surface of the cartridge which is engageable with a supporting surface of the clothes refreshing device. Although the preferred arrangements illustrate a substantially planar surface area of the cartridge engagable with a substantially planar supporting surface in the clothes refreshing device, other surface configurations could be used as well including footed surfaces, curved surfaces, etc.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A fluid supply and reservoir comprising:

a fluid cartridge;

a nozzle assembly securable to said fluid cartridge;

said nozzle assembly including:

a fluid inlet for receiving a supply of fluid from said fluid cartridge, a siphon tube extending from said inlet into said fluid cartridge and a filter element positioned on a free end of said siphon tube, a fluid nozzle opening for said fluid in communication with said siphon tube, an air inlet for receiving a supply of pressurized air, an air nozzle opening for said pressurized air in communication with said air inlet, a chamber between said air nozzle opening and said air inlet, said fluid nozzle opening being positioned in said chamber adjacent said air nozzle opening.

2. A fluid supply and reservoir according to claim 1, wherein said fluid cartridge has a top wall and said nozzle assembly is securable to said top wall, wherein said top wall has an opening surrounded by an upstanding wall, and said nozzle assembly is removably securable to said upstanding wall with said siphon tube extending through said opening into an interior of said fluid cartridge.

3. A fluid supply and reservoir according to claim 2, wherein said top wall has a single opening therein.

4. A fluid supply and reservoir according to claim 2, wherein said top wall has a plurality of openings therein.

5. A fluid supply and reservoir according to claim 2, wherein said nozzle assembly is secured to said upstanding wall by means of threads formed on an exterior of said upstanding wall and mating threads formed on said nozzle assembly.

6. A fluid reservoir and air supply comprising:

a fluid cartridge;

a nozzle assembly securable to said fluid cartridge;

a pressurized air supply;

said nozzle assembly having an air inlet opening for receiving a supply of pressurized air from said pressurized air supply and a sealing surface adjacent said opening;

said pressurized air supply having an air supply tube with an outlet opening and a sealing surface adjacent said opening for sealingly mating with said sealing surface adjacent said inlet opening engageable with said air inlet of said nozzle assembly;

said nozzle assembly including a fluid inlet for receiving a supply of fluid from said fluid cartridge with a siphon tube extending from said fluid inlet; and said nozzle assembly including an outlet for discharging a mixture of fluid and pressurized air.

7. A fluid reservoir and air supply and reservoir according to claim 6, wherein said air supply tube is resiliently biased into engagement with an air inlet opening in said nozzle assembly.

8. A fluid reservoir and air supply according to claim 7, wherein said nozzle assembly comprises a housing which includes a shaped concave surface at said air inlet opening to sealingly mate with a convexly shaped surface formed on an end of said air supply tube.

9. A fluid reservoir and air supply according to claim 6, wherein said cartridge has a top wall with at least one opening therethrough surrounded by a wall and said nozzle assembly is securable to said top wall of said fluid cartridge at said surrounding wall.

10. A fluid reservoir and air supply according to claim 9, wherein said nozzle assembly includes a cap engageable with said wall surrounding said opening in said top wall to secure said cap to said fluid cartridge and said nozzle assembly includes a housing with an opening therein to snugly receive said cap and loosely receive said siphon tube.

11. A fluid reservoir and air supply according to claim 10, wherein said housing includes a wall with slits intersecting said cap opening such that said cap opening is resilient.

12. A fluid reservoir and air supply according to claim 10, wherein said fluid cartridge is sealed from atmospheric pressure and include a cylindrical wall depending from around said top wall opening and has a lower opening positioned a predetermined distance above a bottom wall of said cartridge, the interior of said cylindrical wall being open to atmospheric pressure.

13. A fluid reservoir and air supply according to claim 6, wherein said air supply includes an assembly with a guide wall engageable with said nozzle assembly to align said nozzle assembly with said air supply assembly in a first direction.

14. A fluid reservoir and air supply according to claim 13, wherein said nozzle assembly includes a housing with a slot for receiving and aligning with said guide wall of said air supply assembly.

15. A fluid supply and reservoir according to claim 14, wherein said slot includes outwardly flared open ends to assist in the guidance of said guide wall into said slot.

16. A fluid supply and reservoir according to claim 15, wherein said guide wall comprises a stop for engagement by said nozzle assembly.

17. A fluid supply and reservoir according to claim 6, wherein said nozzle assembly includes a fluid nozzle in communication with said siphon tube and spaced from said outlet.

18. A clothes refreshing appliance comprising:

a cabinet having an interior region for receiving clothing articles to be treated;

a supply of pressurized air;

a removable and replaceable fluid reservoir;

a nozzle assembly removable and replaceable from said cabinet with said fluid reservoir and having an air inlet for receiving pressurized air from said supply, a fluid inlet for receiving fluid from said reservoir and a nozzle outlet for dispensing a mixture of said fluid and air into said interior region.

19. A clothes refreshing appliance according to claim 18, wherein said nozzle assembly and fluid reservoir are replacingly detachable from each other such that either said nozzle assembly or said fluid reservoir could be removed and replaced with a new nozzle supply or fluid reservoir relative to the other.

20. A clothes refreshing appliance according to claim 18, wherein said nozzle assembly and fluid reservoir are replacingly detachable from each other such that either said nozzle assembly or said fluid reservoir could be removed and cleaned or refilled, respectively, relative to the other.

21. A reservoir for use with a clothes refreshing device, said clothes refreshing device having a space for receiving clothing articles and including a nozzle supplied with pressurized air for dispensing a fluid onto said clothing articles, said reservoir comprising a container body having a surface engagable with a supporting surface within said clothes refreshing device, said container body including a closable opening defining a fluid connection to said nozzle, and said container including a supply of fluid formulated to be sprayed onto said clothing articles carried in said clothes refreshing device.

22. A reservoir according to claim 21, wherein said container body includes a top surface having at least one opening therein, said opening being defined by an upstanding wall having a surface configuration arranged to securely connect with a connection element for said nozzle.

23. A reservoir according to claim 22, wherein said container body includes two openings in said top surface, one opening having a sealable cap received thereon through which additional fluid can be supplied to an interior of said container body.

24. A reservoir according to claim 23, wherein said one opening and sealable cap include a seal member arranged therebetween.

25. A reservoir according to claim 22, wherein said surface configuration comprises external threads for engaging with internal threads on said connection element for said nozzle.

26. A reservoir according to claim 21, including a removable closure element for said closable opening, said closure element engaging said closable opening in a liquid tight manner.

27. A reservoir according to claim 26, wherein said closure element comprises a removable cap and said closable opening comprises a wall surrounding an opening, said wall and said cap being engagable in a liquid tight manner.

28. A reservoir according to claim 27, wherein said wall and said cap include a seal member arranged therebetween.

29. A reservoir according to claim 28, wherein said seal member comprises an o-ring.

30. A reservoir according to claim 21, wherein said container body surface includes a substantially planar surface area engagable with a substantially planar supporting surface in said clothes refreshing device.

* * * * *